US006488015B2

(12) United States Patent
Isobe

(10) Patent No.: US 6,488,015 B2
(45) Date of Patent: Dec. 3, 2002

(54) REFUELING SYSTEM

(75) Inventor: Hiroki Isobe, Isehara (JP)

(73) Assignee: Nissan Motor, Co., Ltd., Kanagawa (JP)

( * ) Notice: Subject to any disclaimer, the term of this patent is extended or adjusted under 35 U.S.C. 154(b) by 0 days.

(21) Appl. No.: 10/108,902

(22) Filed: Mar. 29, 2002

(65) Prior Publication Data

US 2002/0153374 A1 Oct. 24, 2002

(30) Foreign Application Priority Data

Apr. 24, 2001 (JP) ..... 2001-125826

(51) Int. Cl.[7] ..... F02M 3/04
(52) U.S. Cl. ..... 123/520; 123/516; 123/198 D
(58) Field of Search ..... 123/516, 520, 123/521, 522, 518, 519, 198 D

(56) References Cited

U.S. PATENT DOCUMENTS 4,714,172 A * 12/1987 Morris
5,335,638 A * 8/1994 Mukai ..... 123/520
5,590,634 A * 1/1997 Shinohara ..... 123/520
5,647,333 A * 7/1997 Mukai ..... 123/519
5,669,361 A * 9/1997 Weissinger et al. ..... 123/520
5,676,116 A * 10/1997 Kim ..... 123/518
5,870,997 A * 2/1999 Mukai ..... 123/520
6,253,802 B1 * 7/2001 Enge
6,302,133 B1 * 10/2001 Kobayashi et al. ..... 137/43
6,435,164 B1 * 8/2002 Kaiser et al. ..... 123/516

* cited by examiner

*Primary Examiner*—Carl S. Miller
(74) *Attorney, Agent, or Firm*—Shinjyu Global IP Counselors, LLP

(57) ABSTRACT

A refueling system is provided that can simplify the layout and decreases manufacturing cost by eliminating the vent valve and reducing the number of parts, while enabling easy refueling. A canister adsorbs and cleans fuel vapor generated inside a fuel tank and discharges the cleaned gas to the atmosphere through a canister drain cut valve. A sender unit is provided inside the fuel tank with a fuel level sensor that detects the amount of fuel inside the fuel tank. A controller closes the canister drain cut valve when a vehicle speed sensor detects that the vehicle is stopped and in the refueling condition and the fuel level detected by the fuel level sensor is at or above a first prescribed height.

14 Claims, 3 Drawing Sheets

REFUELING SYSTEM

BACKGROUND OF THE INVENTION

1. Field of the Invention

The present invention generally relates to a refueling system used in a fuel tank of an automobile. More specifically, the present invention relates to an automobile refueling system that has a simplify layout and that decreases manufacturing cost by eliminating a vent valve and reducing the number of parts, while enabling easy refueling.

2. Background Information

Various types of fuel tank refueling systems are known to be used for automobiles and other vehicles. One example of a fuel tank refueling system has a filler tube that directs fuel into the fuel tank is provided in the refueling port so as to face a tip opening. A filler cap is provided on the tip opening of the filler tube and serves to open and close the tip opening. A vent valve is provided on the upper wall section of the fuel tank. The vent valve is connected to a canister via a refueling control valve and a vent line. A vapor cut value is also provided in the upper wall section of the fuel tank. The vapor cut valve is connected to the canister via an engine vacuum cut valve and a fuel vapor line. The refueling control valve is connected to the vicinity the tip opening of the filler tube via a signal line. The upper wall section of the fuel tank communicates with the vicinity the tip opening of the filler tube via a recirculation line.

Next, the operation of this conventional refueling system will be described. With this conventional refueling system, the fuel vapor that is generated inside the fuel tank when the vehicle travels is discharged from the vent valve to the canister via the refueling control valve and the vent line. The cleaned gas that remains after the fuel components have been adsorbed by the canister are discharged to the atmosphere through the canister drain cut valve. When refueling is conducted, the filler cap of the filler tube is removed and a refueling nozzle is inserted through the opening of tip. Fuel flows down the filler tube into the fuel tank. A portion of the fuel inside the fuel tank becomes fuel vapor and is sent to the canister through the refueling control valve and the vent line. Some of this fuel vapor is circulated to the filler tube through the recirculation line. Then, the liquid surface of the fuel inside the fuel tank rises and reaches the bottom end of the recirculation line at the same time it reaches the bottom end of the vent valve. This causes the vent valve to close. Consequently, the pressure inside the fuel tank rises and the liquid surface of the fuel moves up the filler tube. The fuel activates an automatic stop mechanism provided on the refueling nozzle and refueling stops.

Another known refueling system of this type is disclosed in U.S. Pat. No. 4,714,172. The refueling system of this patent has a refueling control valve which is divided into two fluid chambers by a movable wall. The first chamber provides a closeable junction in the vapor recovery passageway between a liquid fuel tank and a vapor storage canister. The second chamber has a combined inlet/outlet, which is interconnected with a signal pressure region in the fuel tank filler tube adjacent to the filler tube cap. A valve plug is fixed to the movable wall so that when the pressure in the first fluid chamber, the signal pressure region and the second fluid chamber are substantially equivalent, the valve plug is positioned to close the vapor recovery passageway. When the closure cap is removed, a filler nozzle is inserted into the filler tube, and liquid fuel is being delivered into the fuel tank, the pressure in the signal pressure region and the second fluid chamber decreases relative to that in the tank and the first fluid chamber, the movable wall is displaced from its normal position causing the valve plug to open the vapor recovery passageway between the fuel tank and the vapor storage canister.

In view of the above, there exists a need for an improved refueling system that overcomes disadvantages in the prior art. This invention addresses this need in the art as well as other needs, which will become apparent to those skilled in the art from this disclosure.

SUMMARY OF THE INVENTION

It has been discovered that the above-mentioned refueling systems have complicated layouts that are expensive to manufacture. This is because the vent valve, which is obstructed by the rise of the fuel surface, is provided on the upper wall section inside the fuel tank.

The object of the present invention is to solve the aforementioned problems. Another object of the present invention is to eliminate the vent valve, and reduce the number of parts. Thus, the present invention provides a refueling system that can have a simplified layout and that can be relatively inexpensive to manufacture.

In order to achieve these objects, a refueling system is provided that basically comprises a canister, a canister drain cut valve, a fuel level detecting device, a refueling detecting device and a refueling controller. The canister is configured to adsorb and clean fuel vapor generated inside a fuel tank. The canister drain cut valve is operatively coupled to the canister and configured to discharge air cleaned by the canister. The fuel level detecting device is configured to be operatively coupled in the fuel tank to detect fuel level inside the fuel tank. The refueling detecting device is configured be operatively coupled in the fuel tank to detect if fuel is being delivered to the fuel tank. The refueling controller is configured to open the canister drain cut valve when the refueling detecting device detects that fuel is being delivered and to close the canister drain cut valve when the fuel level detected by the fuel level detecting device is greater than a first prescribed height.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

Figure 1:
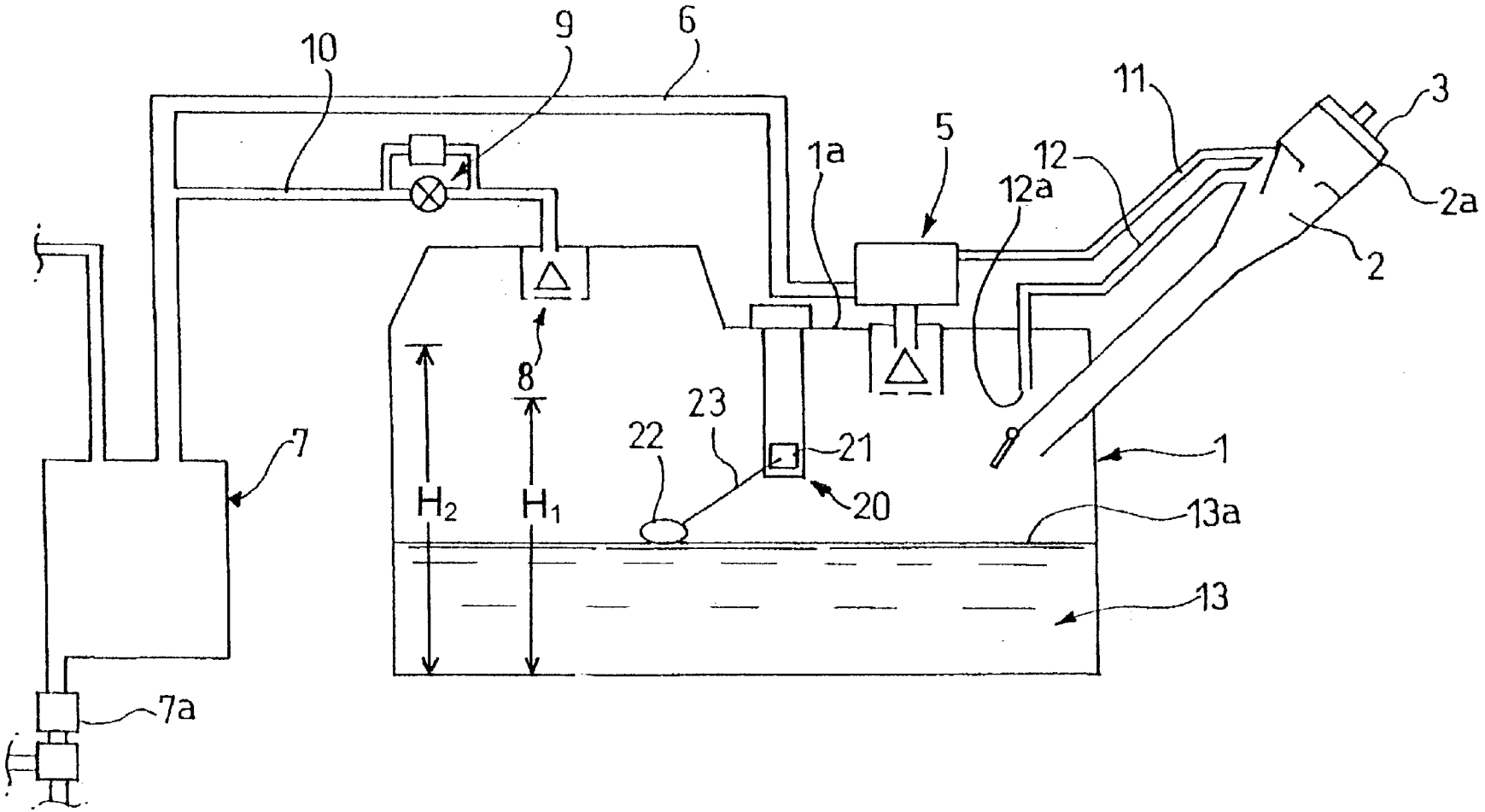
FIG. 1 is a simplified schematic view of a refueling system in which only the overall constituent features of the refueling system are illustrated in accordance with one embodiment of the present invention.
Figure 2:
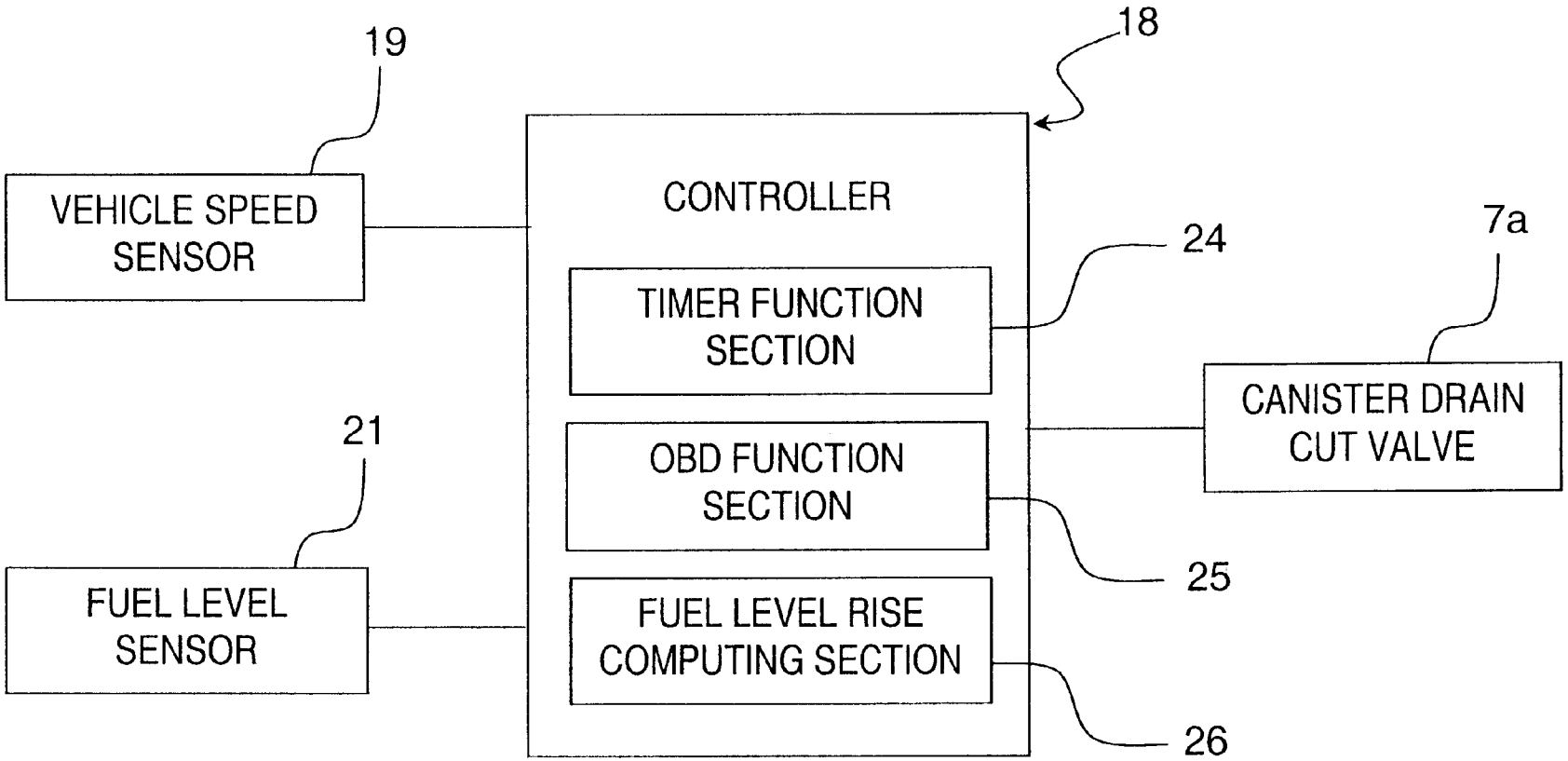
FIG. 2 is a block diagram of a controller for the refueling system illustrated in FIG. 1 in accordance with one embodiment of the present invention.
Figure 3:
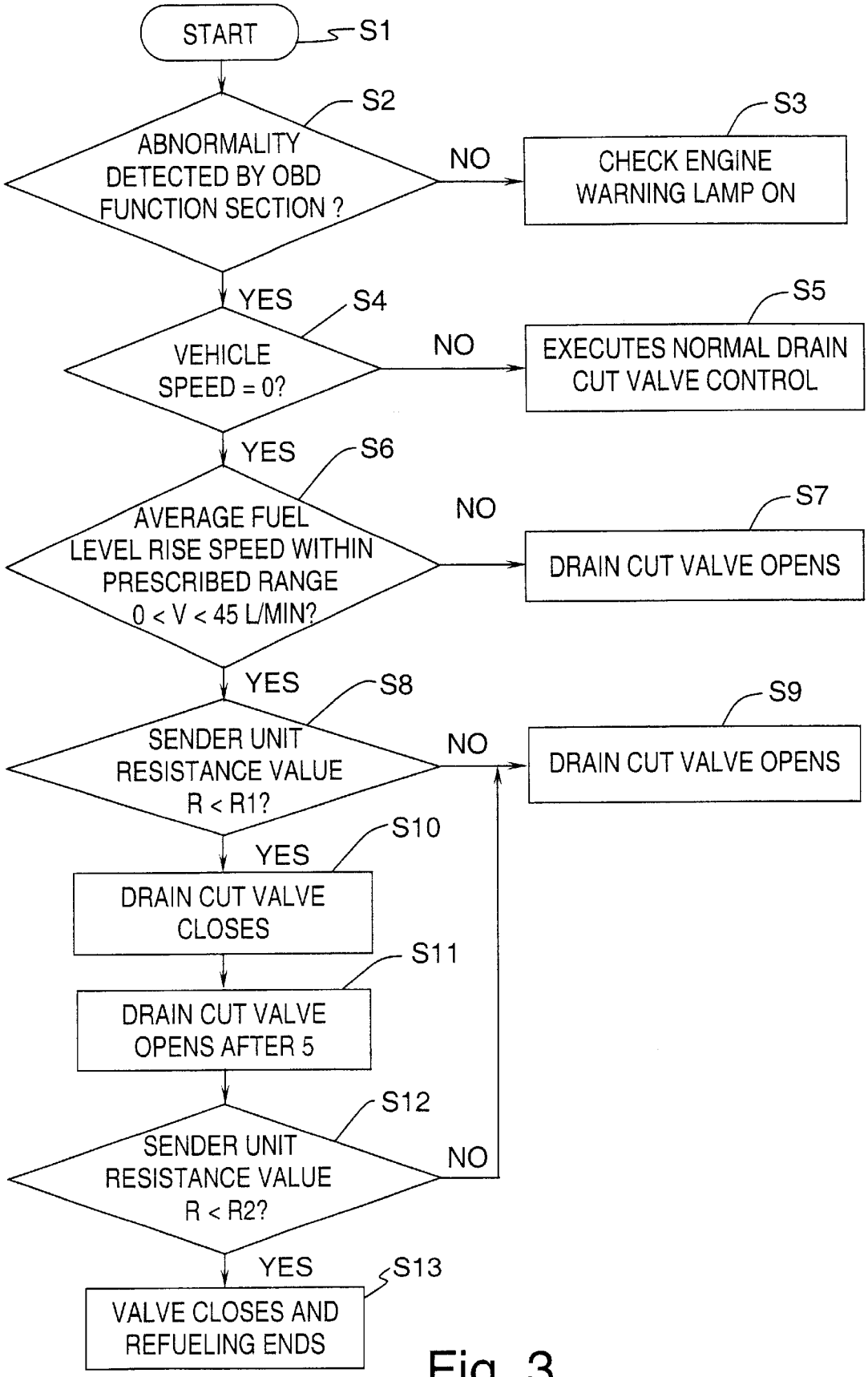
FIG. 3 is a flowchart of control procedure for the controller of the refueling system illustrated in FIG. 1 in accordance with one embodiment of the present invention.

Referring to FIGS. 1–3, a refueling system is illustrated in accordance with a first embodiment of the present invention. The refueling system of the present invention basically has a fuel tank 1 with a filler tube 2 that is used for refueling and directing the fuel to the inside of the fuel tank 1. The fuel tank 1 is provided on a vehicle body of an automobile in a conventional manner. A filler cap 3 is provided on the tip opening 2*a* of the filler tube 2 and serves to open and close the tip opening 2*a*.

A refueling control valve 5 is provided in the upper wall section 1*a* of the fuel tank 1. A vent line 6 is fluidly coupled to the refueling control valve 5 to direct to a canister 7 that adsorbs fuel vapor and discharges cleaned air through a canister drain cut valve 7*a*. During refueling, fuel vapors are also circulated to the vicinity of the tip opening 2*a* of the filler tube 2 through a recirculation line 12.

A vapor cut valve 8 is provided on the upper wall section 1*a* of the fuel tank 1 at a position that is higher than the refueling control valve 5. The vapor cut valve 8 is connected to the canister 7 through an engine vacuum cut valve 9 and a fuel vapor line 10. The upper wall section 1*a* of the fuel tank 1 fluidly communicates with the vicinity of the tip opening 2*a* of the filler tube 2 through the recirculation line 12 having a lower opening 12*a* located in the fuel tank 1.

The refueling control unit or controller 18 preferably includes a microcomputer with a control program that controls the opening and closing of the canister drain cut valve 7*a* as discussed below. The controller 18 can also include other conventional components such as an input interface circuit, an output interface circuit, and storage devices such as a ROM (Read Only Memory) device and a RAM (Random Access Memory) device. The controller 18 is operatively coupled to the canister drain cut valve 7*a,* a vehicle speed sensor 19 and a sender unit 20 in a conventional manner. The controller 18 is capable of selectively controlling any of the components of the control system in accordance with the control program. It will be apparent to those skilled in the art from this disclosure that the precise structure and algorithms for the controller 18 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

A sender unit 20 is disposed inside an upper area of the fuel tank 1. In particular, an upper end of the sender unit 20 is partially fixed to the upper wall section 1*a* of the fuel tank 1. The sender unit 20 includes a fuel level sensor 21 operatively coupled thereto. The fuel level sensor 21 detects the amount of fuel 13 or the fuel level in the fuel tank 1. The fuel level sensor 21 is one of the parts that make up a refueling detecting device in this embodiment of the present invention. The fuel level sensor 21 is operatively coupled to the controller 18 to input a control signal that is indicative of the amount of fuel 13 or the fuel level in the fuel tank 1.

The fuel level sensor 21 basically includes an arm part 23 provided with a float 22 that rises and falls with the liquid surface 13*a* of the fuel 13. The arm part 23 is pivotally attached to the sender unit 20 such that it can swing freely with the rise and fall of the fuel in the fuel tank 1. The fuel level sensor 21 is preferably configured and arranged such that it detects the swing angle of the arm part 23. Preferably, the fuel level sensor 21 uses a plurality of resistors having differing resistance values R. The resistors are provided in multiple steps for each angle and send a control signal that is indicative of the height of the liquid surface 13*a* to the controller 18. Thus, the fuel level sensor 21 establishes the fuel level of the fuel tank 1.

The refueling system of the present invention is configured and arranged such that the resistance value R of the fuel level sensor 21 decreases as the liquid surface 13*a* rises and increases as the liquid surface 13*a* falls. One of the resistors is arranged to detect when the liquid surface 13*a* (the fuel level) in the fuel tank 1 has reached or exceeded a first prescribed height $H_1$ that indicates that the liquid surface 13*a* (the fuel level) in the fuel tank 1 has reaches or exceeds a height slightly less than the full level of the fuel tank 1. In other words, when the resistance value R of the resistors of the fuel level sensor 21 falls below a resistance value R1, then the fuel level has reached or exceeded the first prescribed height $H_1$. As a result, the controller 18 determines that the tank 1 is almost full, and closes the canister drain cut valve 7*a* of the canister 7. Another one of the resistors is arranged to detect when the liquid surface 13*a* (the fuel level) in the fuel tank 1 has reached or exceeded a second prescribed height $H_2$. The second prescribed height $H_2$ indicates that the liquid surface 13*a* (the fuel level) in the fuel tank 1 has reached or exceeded the full level of the fuel tank 1. In other words, when the resistance value R of the resistors of the fuel level sensor 21 falls below a resistance value R2, then the fuel level has reached or exceeded the second prescribed height $H_2$ or full level of the fuel tank 1. Thus, the second height $H_2$ is slightly higher than the first height $H_1$.

When the fuel level reaches the second prescribed height $H_2$, the resistance value R will fall below resistance value R2, such that the controller 18 determines that the tank 1 is full and closes the canister drain cut valve 7*a* of the canister 7.

Also, when the fuel level detected by the fuel level sensor 21 is at or above the first prescribed height $H_1$ and below the second prescribed height $H_2$ (which is higher than the first height $H_1$), the controller 18 closes the canister drain cut valve 7*a,* and then opens the canister drain cut valve 7*a* after a prescribed duration of time has elapsed. Preferably, the prescribed duration of time is about five seconds.

As shown in FIG. 2, the controller 18 is provided with a timer function section 24, an OBD function section 25 and a fuel level rise computing section 26. The time function section 24 establishes the timing for opening and closing the canister drain cut valve 7*a*. The OBD function section 25 has a function (On Board Diagnostic system) for conducting failure diagnostics on a fuel gauge, the fuel level sensor 21, the sender unit 20 and the canister drain cut valve 7*a*. Preferably, the OBD function section 25 illuminates a warning lamp that is provided on the perimeter of a gauge section of an instrument panel inside the vehicle when there is an abnormality detected. The fuel level rise speed computing section 26 serves as a level rise speed detecting device that obtains the rise speed by computing the change per unit time of the fuel level detected by the fuel level sensor 21.

The canister 7 is configured such that after it adsorbs and cleans the fuel vapor from the fuel tank 1, it can discharge the cleaned air to the atmosphere through the canister drain cut valve 7*a* and a valve body 27. Furthermore, the canister drain cut valve 7*a* and the valve body 27 are electrically connected to the controller 18, as shown in FIG. 2, so that the valve body 27 (which is provided between the canister and the atmosphere) can be opened and closed in response to a control signal from the controller 18.

The vehicle speed sensor 19 detects the vehicle speed and produces a control signal that is indicative of the vehicle speed. The vehicle speed sensor 19 is preferably also used for the speedometer display on the instrument panel of the vehicle. The vehicle speed sensor 19 serves as the vehicle stop detecting device (which is one of the parts of the refueling detecting device) that is operatively connected to the controller 18. When the vehicle speed sensor 19 and the fuel level sensor 21 (the other part of the refueling detecting device) detect that refueling is taking place, the controller 18 opens and closes the canister drain cut valve 7*a* in response to the liquid surface height detected by the fuel level sensor 21.

Now, the operation of the refueling system in accordance with one embodiment of the present invention is explained using the flowchart shown in FIG. 3. In Step S1 of the refueling system of the present invention, control starts. In step S2, the OBD function section 25 of the controller 18 conducts a failure analysis of the fuel gauge, the fuel level sensor 21, the sender unit 20 and the canister drain cut valve 7*a* to determine if any abnormality or failures are present. If an abnormality or failure is found, then control proceeds to Step S3. A warning lamp (Check Engine Warning Lamp) is also illuminated (turned ON) upon the OBD function section 25 upon detecting an abnormality or failure. Preferably, the warning lamp is located on the perimeter of the gauge section of the instrument panel inside the vehicle.

When there are no abnormalities or failures, control proceeds to Step S4, where the vehicle speed sensor 19 measures the vehicle speed. When the vehicle speed measurement by the vehicle speed sensor 19 indicates that the vehicle speed is not 0 km/s (vehicle moving), then control proceeds to Step S5, where normal open/close control of the canister drain cut valve 7*a* is executed by the controller 18 to control the fuel vapor. Therefore, the canister drain cut valve 7*a* can be prevented from closing when the liquid surface 13*a* rises due to undulation of the fuel 13 that occurs while the vehicle is moving.

If the vehicle speed measured by vehicle speed sensor 19 is 0 km/s (vehicle not moving), control proceeds to Step S6. In Step S6, refueling is confirmed and when the average fuel level rise speed V inside the fuel tank 1 is within a prescribed range $0<V<45$ L/min, then control proceeds to Step S8. Otherwise, control proceeds to Step S7, where the canister drain cut valve 7*a* is opened. The canister drain cut valve 7*a* continues to remain open until the control program runs through a cycle in which the controller 18 determines the conditions are met to close the canister drain cut valve 7*a*.

In Step S8, until the resistance value R of the fuel level sensor 21 becomes smaller than the prescribed resistance value R1, the fuel level in the fuel tank 1 is determined to still be low and control proceeds to Step S9, where the canister drain cut valve 7*a* continues to remain open until the control program runs through a cycle in which the controller 18 determines the conditions are met to close the canister drain cut valve 7*a*.

When the liquid surface rises beyond the first height $H_1$ and the resistance value R falls below the prescribed resistance value R1, the controller 18 determines that the liquid surface 13*a* of the fuel 13 has gotten close to the upper wall section 1*a* of the fuel tank 1 and proceeds to Step S10, where it closes the canister drain cut valve 7*a*.

When the canister drain cut valve 7*a* has closed, control proceeds to Step S11 and the timer function section 24 ofthe controller 18 begins counting for a prescribed time period, e.g. five seconds. During this period, the internal pressure of the fuel tank 1 increases and raises the liquid surface 13*a* of the fuel 13 inside the filler tube 2, thus activating the automatic stop mechanism provided in the refueling nozzle and stopping the refueling.

The canister drain cut valve 7*a* is opened when the count of the timer function section 24 indicates that five seconds (prescribed time) have elapsed since the closing of the canister drain cut valve 7*a*. As a result, the internal pressure of the fuel tank 1 decreases and the surface 13*a* of the fuel 13 inside the filler tube 2 falls. Then, additional refueling can be conducted from the refueling nozzle.

In Step S12, the amount of additional refueling is restricted using the fuel level sensor 21. That is, until the resistance value R of the fuel level sensor 21 becomes smaller than the prescribed resistance value R2, the fuel level is determined to still be low and control proceeds to Step S9, where the canister drain cut valve 7*a* continues to remain open until the control program runs through a cycle in which the controller 18 determines the conditions are met to close the canister drain cut valve 7*a*.

When the liquid surface 13*a* rises beyond the second height $H_2$ and the resistance value R falls below the prescribed resistance value R2, the controller 18 determines that the surface 13*a* of the fuel 13 has almost reached the upper wall section 1*a* of the fuel tank 1 (i.e., the tank is full) and proceeds to Step S13, where it closes the canister drain cut valve 7*a* and ends refueling.

Thus, when it is determined that fuel 13 is being delivered based on the information provided by the vehicle speed sensor 19 and the fuel level sensor 21, the controller 18 closes the canister drain cut valve 7*a* when the fuel level sensor 21 indicates that a prescribed fuel amount has been reached. As a result, the internal pressure inside the fuel tank 1 rises and the fuel level rises inside the filler tube 2 and activates the automatic stop sensor of the refueling nozzle.

The refueling detecting device (the vehicle speed sensor 19 and the fuel level sensor 21) of the refueling system of the present invention determines that refueling is taking place when vehicle speed sensor 19 detects that the vehicle is in a stopped condition and the fuel level rise speed computing section 26 (which computes the level rise speed based on fuel level data obtained from the fuel level sensor 21) detects that the fuel level rise speed lies within a prescribed range. Therefore, the refueling system can determine reliably whether or not refueling is taking place.

The timer function section 24 of the controller 18 allows additional refueling by opening the canister drain cut valve 7*a*. Thus, even after automatic stop when the pressure inside the fuel tank 1 is high, the canister drain cut valve 7*a* is opened after a prescribed amount of time has elapsed and the pressure is reduced, making it possible to deliver additional fuel and fill the fuel tank 1 with fuel.

Furthermore, the vehicle speed sensor 19 prevents the refueling system from erroneously detecting that refueling is taking place when the vehicle is moving. Consequently, the canister drain cut valve 7*a* does not close when the fuel level varies due to vibrations. Thus, the pressure inside the fuel tank 1 can be held at a prescribed pressure.

Furthermore, the fuel level sensor 21, which is provided on the sender unit 20 and used as the fuel level detecting device for the vehicle, is the fuel level sensor already used for displaying the fuel amount on the fuel gauge provided on the gauge section of the instrument panel inside the vehicle.

Meanwhile, the fuel level rise speed computing section 26 obtains the rise speed by computing the change per unit time of the fuel level detected by the fuel level sensor 21. Thus, the vehicle stop detecting device can detect if the vehicle is stopped using an output signal from the vehicle speed sensor 19, which is already installed on the vehicle, and the fuel level rise speed computing section 26 (which comprises the fuel level rise speed detecting device) can detect the rise speed using fuel level data detected by the fuel level sensor 21. Consequently, the refueling detecting device (the vehicle speed sensor 19 and the fuel level sensor 21) can be constructed without installing new sensor equipment and increases in cost can be suppressed.

Thus, the refueling system of the present invention uses the controller 18 to open the canister drain cut valve 7*a* when the refueling detecting device (the vehicle speed sensor 19 and the fuel level sensor 21) detects that fuel is being delivered and close the canister drain cut valve 7*a* when the fuel level sensor 21 detects that the fuel level is at or above the first prescribed height $H_1$. Therefore, the internal pressure of the fuel tank 1 increases and raises the fuel level inside the filler tube 2, thus activating the automatic stop sensor of the refueling nozzle. Furthermore, since the refueling detecting device (the vehicle speed sensor 19 and the fuel level sensor 21) does not detect that fuel is being delivered when the vehicle is traveling, the canister drain cut valve 7*a* is not obstructed and the pressure inside the fuel tank 1 can be held at the desired pressure. Therefore, the conventionally used vent valve can be eliminated and the number of parts can be reduced, thus making it possible to simplify the layout and suppress increases in manufacturing cost.

In the present invention, the refueling detecting device (the vehicle speed sensor 19 and the fuel level sensor 21) can reliably determine if refueling is taking place because it determines that fuel is being delivered when the vehicle stop detecting device or speed sensor 19 detects that the vehicle is in a stopped condition and the fuel level rise speed detecting device detects that the fuel level. is rising at a speed that lies within a prescribed range.

The refueling system of the present invention is configured and arranged such that when the fuel level detected by the fuel level sensor 21 is at or above the first prescribed height $H_1$ and below the second prescribed height $H_2$, the canister drain cut valve 7*a* first closes and then opens after a prescribed amount of time has elapsed. Therefore the canister drain cut valve 7*a* closes temporarily and remains closed for a prescribed amount of time even after refueling stops. The canister drain cut valve 7*a* then opens to allow additional refueling. This feature improves the marketability of the invention.

The refueling system of the present invention was described in the previous paragraphs based on the drawings, but the present invention is not limited to this embodiment. The scope of the present invention includes design changes that do not change the gist of the invention. For example, although the refueling system of the present invention uses vehicle speed sensor 19 as a refueling detecting device, the invention is not limited to this arrangement. It is also acceptable, for example, to use a sensor to detect whether the filler cap 3 is open or closed and determine that refueling is taking place when the filler cap 3 is open and that the vehicle is moving when the filler cap 3 is closed. Another method is to interlock with a fuel lid opener provided near the driver's seat and determine that refueling is taking place when the fuel lid opener is operated. Any arrangement is acceptable so long as it can detect if fuel is being delivered to the fuel tank 1.

Also, the refueling system of the present invention uses the fuel level sensor 21 (which detects the swing angle of the arm part 23 that has the float 22 on its tip) as a fuel amount detecting device that can detect the fuel amount, but the present invention is not limited to this arrangement. For example, it is also acceptable to use a linear level sensor that detects the height of the liquid surface linearly. Any kind of sensor is acceptable so long as it can detect if the fuel amount.

Furthermore, the refueling system of the present invention is arranged such that the canister drain cut valve 7*a* closes as refueling progresses and the count of timer function section 24 causes the canister drain cut valve 7*a* to open five seconds after the fuel level begins to rise up the filler tube 2, but the invention is not limited to this arrangement. Any arrangement is acceptable so long as the canister drain cut valve 7*a* is opened again after a prescribed amount of time has elapsed.

The term "configured" as used herein to describe a component, section or part of a device includes hardware and/or software that is constructed and/or programmed to carry out the desired function. As used herein, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2001-125826. The entire disclosure of Japanese Patent Application No. 2001-125826 is hereby incorporated herein by reference.

While only selected embodiments have been chosen to describe the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents. Thus, the scope of the invention is not limited to the disclosed embodiments.

What is claimed is:

1. A refueling system comprising:

a canister configured to adsorb and clean fuel vapor generated inside a fuel tank, a canister drain cut valve operatively coupled to said canister and configured to discharge air cleaned by said canister;

a fuel level detecting device configured to be operatively coupled in the fuel tank to detect fuel level inside the fuel tank, a refueling detecting device configured be operatively coupled in the fuel tank to detect if fuel is being delivered to the fuel tank, and a refueling controller configured to open said canister drain cut valve when said refueling detecting device detects that fuel is being delivered and to close said canister drain cut valve when the fuel level detected by said fuel level detecting device is at or above a first prescribed height.

2. The refueling system as recited in claim 1, wherein said refueling detecting device includes a vehicle stop detecting device configured to detect if the vehicle is in a stopped condition, and a fuel level rise speed detecting device configured to detect rate at which the fuel level is rising.

3. A refueling system as recited in claim 2, wherein said vehicle stop detecting device is configured to detect if the vehicle is in a stopped position based on an output signal from a vehicle speed sensor, and said fuel level rise speed detecting device is configured to detect the rise speed of the fuel level based on an output signal from a sender unit.

4. The refueling system as recited in claim 1, wherein said refueling controller being configured to first close said canister drain cut valve and then opens said canister drain cut valve after a prescribed amount of time has elapsed, when the fuel level detected by said fuel level detecting device is at or above said first prescribed height and below a second prescribed height that is higher than said first prescribed height.

5. The refueling system as recited in claim 4, wherein said second prescribed height is equal to a full level of the fuel tank.

6. The refueling system as recited in claim 4, wherein said first prescribed height is slightly less than a full level of the fuel tank.

7. The refueling system as recited in claim 2, wherein said refueling controller being configured to first close said canister drain cut valve and then opens said canister drain cut valve after a prescribed amount of time has elapsed, when the fuel level detected by said fuel level detecting device is at or above said first prescribed height and below a second prescribed height that is higher than said first prescribed height.

8. The refueling system as recited in claim 7, wherein said second prescribed height is equal to a full level of the fuel tank.

9. The refueling system as recited in claim 7, wherein said first prescribed height is slightly less than a full level of the fuel tank.

10. The refueling system as recited in claim 3, wherein said refueling controller being configured to first close said canister drain cut valve and then opens said canister drain cut valve after a prescribed amount of time has elapsed, when the fuel level detected by said fuel level detecting device is at or above said first prescribed height and below a second prescribed height that is higher than said first prescribed height.

11. The refueling system as recited in claim 10, wherein said second prescribed height is equal to a full level of the fuel tank.

12. The refueling system as recited in claim 10, wherein said first prescribed height is slightly less than a full level of the fuel tank.

13. The refueling system as recited in claim 1, wherein said first prescribed prescribed height is slightly less than a full level of the fuel tank.

14. A refueling system comprising:

fuel vapor adsorption means for adsorbing and cleaning fuel vapor generated inside a fuel tank;

fuel vapor discharge means for selectively discharging air cleaned by said fuel vapor adsorption means;

fuel level detecting means for detecting fuel level inside the fuel tank, refueling detecting means configured to detect if fuel is being delivered to the fuel tank, and a refueling control means for controlling fuel vapor discharge means to discharge the air cleaned by said fuel vapor adsorption means when said refueling detecting means detects that fuel is being delivered and stop discharging the air cleaned by said fuel vapor adsorption means when the fuel level detected by said fuel level detecting means is at or above a first prescribed height.

* * * * *